United States Patent [19]

Weir

[11] Patent Number: 4,605,439

[45] Date of Patent: Aug. 12, 1986

[54] RECOVERY OF GOLD FROM REFRACTORY AURIFEROUS IRON-CONTAINING SULPHIDIC MATERIAL

[75] Inventor: Donald R. Weir, Fort Saskatchewan, Canada

[73] Assignee: Sherritt Gordon Mines Limited, Toronto, Canada

[21] Appl. No.: 708,203

[22] Filed: Mar. 4, 1985

[30] Foreign Application Priority Data

Sep. 27, 1984 [CA] Canada ..... 464182

[51] Int. Cl.[4] ..... C22B 11/04

[52] U.S. Cl. ..... 75/118 R; 423/27; 423/30; 423/36; 423/42; 423/45; 423/140; 423/146; 423/150; 75/2; 75/101 R; 75/105; 75/115

[58] Field of Search ..... 423/27, 36, 29, 42, 423/30, 31, 150, 140, 146; 75/105, 2, 101 R, 115, 118 R

[56] References Cited

U.S. PATENT DOCUMENTS 4,266,972 5/1981 Redondo-Abad et al. ..... 423/36

4,304,644 12/1981 Victorovich et al. ..... 423/36

*Primary Examiner*—John Doll

*Assistant Examiner*—Robert L. Stoll

*Attorney, Agent, or Firm*—Robert F. Delbridge; Arne I. Fors

[57] ABSTRACT

A process for the recovery of gold from refractory auriferous iron-containing sulphidic material which comprises providing an aqueous feed slurry of fresh feed material and oxidized solids from a subsequent pressure oxidation step. The feed slurry has a pulp density in the range of from about 30 to about 60% by weight. The slurry is subjected to pressure oxidation at a temperature of from about 120° to about 250° C. under a total pressure of from about 360 to about 6000 kPa to produce a slurry of oxidized solids. A portion of the oxidized solids is recycled to the feed slurry, and gold is recovered from the remaining oxidized solids.

7 Claims, 1 Drawing Figure

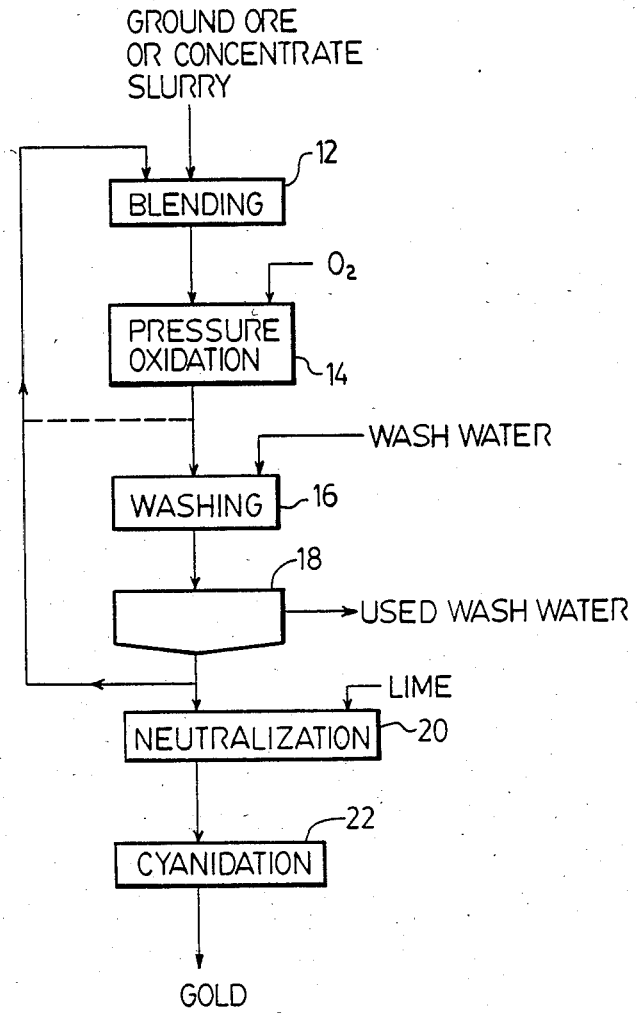
GROUND ORE
OR CONCENTRATE
SLURRY
12
BLENDING
$O_2$
PRESSURE
OXIDATION
14
WASH WATER
WASHING
16
18
USED WASH WATER
LIME
NEUTRALIZATION
20
22
CYANIDATION
GOLD

RECOVERY OF GOLD FROM REFRACTORY AURIFEROUS IRON-CONTAINING SULPHIDIC MATERIAL

This invention relates to the recovery of gold from refractory auriferous iron-containing sulphidic material, for example ore or concentrate.

It is known that the recovery of gold from refractory auriferous sulphidic material by cyanidation is improved if the material is first subjected to a pressure oxidation treatment to liberate gold from refractory material, see for example U.S. Pat. No. 2,777,764 (Hedley et al) issued Jan. 15, 1957. In the pressure oxidation treatment it is desirable to fully oxidize the sulphide sulphur to the sulphate form for effective liberation of the gold.

The sulphidic minerals present are usually predominantly arsenopyrite and/or pyrite and may also include appreciable amounts of pyrrhotite as well as less amounts of base metal sulphides such as zinc, lead and copper sulphides. Elemental sulphur may be formed as an intermediate or primary oxidation product in the pressure oxidation treatment and, since the pressure oxidation treatment is usually carried out at temperatures of from about 120° to 250° C., more commonly from about 140° to about 200° C., the sulphur is present in a molten state. Molten sulphur has a strong tendency to wet and/or coat many of the sulphides, with resultant formation of agglomerates of sulphur and unreacted sulphides, and can consequently severely limit oxidation and gold liberation. This is especially the case in continuous operations in which the agglomerates may build up to the point where they remain in and build up in the reaction vessel. Also, the presence of elemental sulphur is detrimental to subsequent gold recovery by cyanidation, not only because of increased consumption of cyanide but also because molten sulphur has an affinity to collect gold and hinder access of the cyanide solution to the gold.

Although the prior art teaches use of various additives, such as lignosulphonates or quebracho in the pressure oxidation of sulphides to reduce problems caused by molten sulphur, see U.S. Pat. No. 3,867,268 (Kawulka et al) issued Feb. 18, 1975, it has been found that the use of such additives is not commercially desirable in the pressure oxidation of refractory auriferous sulphidic material which contains arsenopyrite, pyrite or pyrrhotite, because undesirably large quantities of additives are required with consequent expense.

The use of higher reaction temperatures, i.e. above about 235° C., may to some extent overcome the problem by providing more rapid oxidation of elemental sulphur, but it is doubtful whether this would be effective in a continuous operation. In any event, use of such high temperatures is undesirable because of higher equipment costs.

The use of reaction temperatures below the melting point of sulphur, i.e. below about 120° C., in the pressure oxidation treatment of refractory auriferous sulphidic materials has been proposed, see for example Canadian Pat. No. 1,080,481 (Wyslonizil) issued July 1, 1980. However, with such treatment, the sulphur content of arsenopyrite, pyrrhotite and many of the base metal sulphides is oxidized to elemental sulphur to an undesirable extent, and much of the pyrite tends to remain unreacted. It has been proposed to digest the oxidized solids in a caustic solution to dissolve and remove the elemental sulphur. This is also undesirable, not only because an additional step is involved, but also because the caustic solution reacts with ferric arsenate and sulphur-containing iron precipitates formed during the pressure oxidation treatment and disposal or treatment of the resultant solution presents additional problems because the resultant solution will usually contain polysulphides, arsenate, sulphate and possibly a variety of unsaturated sulphur compounds.

It is therefore an object of the invention to provide a process for the pressure oxidation treatment of refractory auriferous iron-containing sulphidic material in which the previously mentioned problems caused by the presence of molten sulphur are substantially reduced.

The present invention is based on the discovery that the problem of sulphide wetting by molten sulphur and the attendant problem of agglomeration can be substantially overcome at pressure oxidation treatment temperatures above about 120° C., without resorting to excessively high temperatures or excessive amounts of additives, by the addition of relatively inert solids to the fresh feed of refractory auriferous iron-containing sulphidic material in the form of ore or concentrate to provide a relatively high slurry pulp density at least in the initial stages of the treatment where elemental sulphur formation is more likely to occur, i.e. in the initial compartments of a multi-compartment horizontal autoclave, the initial reactors or kettles of a series of reactors or the initial portion of a tubular or pipeline reactor. It has been found that such addition of relatively inert solids apparently promotes dispersion of elemental sulphur which is formed, thereby reducing the tendency for agglomeration, and also promotes suspension of any agglomerates which are formed, thereby allowing them to react more completely.

The addition of relatively inert solids to the fresh feed to form a feed slurry of relatively high pulp density in accordance with the invention is preferable to the use of fresh feed alone to provide a high pulp density since the resultant high sulphur content (and probably also arsenic content) may result in the production of excessive heat in the pressure oxidation treatment. The present invention may also be preferable to the production in a preliminary flotation step of low sulphur grade concentrates for use in the pressure oxidation treatment, since in such a flotation step the sulphidic material is in effect diluted with gangue. The relatively high amounts of gangue in such low sulphur grade concentrate may cause problems in the pressure oxidation treatment, when relatively high pulp density is used. For example, the original ore may contain relatively high levels of carbonates which, if present in the pressure oxidation treatment, generate carbon dioxide which requires considerable venting with attendant losses of oxygen. Also, the acid consuming content of many refractory gold ores may be in excess of the acid available from the oxidation of sulphur thereby necessitating the addition of acid to the system.

In accordance with the invention, the feed slurry pulp density at least in an initial stage of the pressure oxidation treatment is maintained at a relatively high values, for example from about 30 to about 60% solids by weight, preferably from about 40 to about 55%, by the addition of relatively inert solids to fresh feed, which may be ore or concentrate. The relatively inert solids may be provided by recycling a portion of the material which has been subjected to pressure oxidation treatment prior to or after liquid-solids separation. Oxidized slurry is usually subjected to a liquid-solids separation step and the solids are usually washed, for example in a countercurrent decantation thickener circuit, prior to processing the oxidized solids through a cyanidation circuit. Although oxidized slurry direct from the pressure oxidation treatment may be recycled, it will usually be preferable to recycle oxidized solids which have been subjected to liquid-solids separation and a wash stage, since such washed solids will be cooler than oxidized slurry directly from pressure oxidation treatment. However, if the acid consuming gangue content of the fresh feed is high (for example with relatively high carbonate content), it may be preferable to recycle oxidized slurry to maximize the amount of acid recycled and hence facilitate decomposition of the carbonates. The amount of solids recycled to obtain the relatively high pulp density will primarily depend upon the sulphur content of the feed solids and may be in the range of from about 0.5:1 to 10:1 by weight, preferably from about 2.5:1 to about 4:1, relative to the fresh feed.

It has been found that such recycle of oxidized material to provide a high pulp density substantially reduces agglomeration, thereby facilitating continuous operation. It has also been found that completely oxidized residue efficiently dispenses elemental sulphur, preventing its selective wetting of unreacted sulphidic materials and consequently their agglomeration. Also, the recycled oxidized material will contain acid which tends to decompose carbonates in the fresh feed. The resultant carbon dioxide is thus removed prior to the pressure oxidation treatment, thereby maximizing oxygen utilization. The recycled oxidized material also contains soluble iron and/or readily soluble iron, and it has been found that such iron promotes the oxidation reaction.

The recycled oxidized material has also been found effective in batch operations by accelerating the oxidation and effecting more complete liberation of gold than if fresh feed is oxidized alone. Also, the recycle of solids provides, if effect, additional retention time for incompletely reacted sulphides.

The invention is particularly useful where a plurality of mineral types are being treated. For example, a refractory gold concentrate may contain pyrrhotite, pyrite and arsenopyrite, and a zinc concentrate may contain galena, sphalerite, marmatite and pyrite. Some of these minerals are more reactive than others, and further the most reactive minerals have a propensity for producing elemental sulphur as an intermediate reaction product.

Embodiments of the invention will now be described, by way of example, with reference to the accompanying drawing which shows a flow diagram of gold recovery process.

Referring to the drawing, fresh ground refractory auriferous iron-containing sulphidic ore or concentrate is slurried to form an aqueous slurry which is fed to a blending step 12 to which washed oxidized solids from a subsequent pressure oxidation step (to be described in more detail later) is also fed to form an aqueous feed slurry with a relatively high pulp density of from about 30 to about 60% solids by weight, preferably from about 40 to 55%. The high pulp density slurry is then subjected to a pressure oxidation step 14 in a multi-compartment horizontal autoclave at a temperature of from about 120° to about 250° C. under a total pressure of from about 350 to about 6000 kPa for a retention time sufficient to effect adequate oxidation of the sulphides to sulphates.

Oxidized slurry from the pressure oxidation step 14 then proceeds to a washing step 16 where water is added to the slurry. The diluted slurry then passes to a liquid-solids separation step 18 comprising a thickener where used wash water is removed as thickener overflow. A portion of the oxidized solids in the thickener underflow is then recycled to the blending step for mixing with incoming fresh feed slurry to form the feed slurry of relatively high pulp density for subsequent pressure oxidation. The weight ratio of recycled oxidized solids to fresh feed may be in the range of from about 0.5:1 to 10:1, preferably from about 2.5:1 to about 4:1.

The remaining solids are passed to a neutralization step 20 where a neutralizing agent such as lime is added to raise the pH of the slurry to a value suitable for cyanidation, for example about 10.5. The neutralized slurry then proceeds to a cyanidation step 22 where gold is recovered.

Alternatively, instead of oxidized solids from the thickener 18 being recycled to the blending step 12, the recycling of oxidized solids may be effected by recycling some of the oxidized slurry leaving the autoclave in the pressure oxidation step 14, as indicated by dotted line in the drawing.

The results of various tests carried out in connection with the invention will now be described.

EXAMPLE 1

Tests were carried out with a concentrate containing 33.4 g/t Au, 12.4% As, 33.3% Fe and 21.4% S. It was first found that conventional cyanidation extracted 30% Au, yielding a residue containing 23.3 g/t Au.

EXAMPLE 2

Such concentrate was also subjected to batch pressure oxidation treatment in accordance with the prior art at a pulp density of 10% solids, 85 kg/t $H_2SO_4$ and 1750 kPa total pressure. Samples were taken at predetermined time intervals and amount of sulphur oxidation to sulphate was measured as well as gold extraction in subsequent cyanidation. The results are shown in Table 1.

TABLE 1

| | Oxidation time min. | | | | | |
|---|---|---|---|---|---|---|
| | 10 | 20 | 40 | 80 | 120 | 180 |
| % sulphur oxidation to sulphate | 30 | 58 | 65 | 83 | 93 | 96 |
| % gold extraction | 54 | 51 | 76 | 87 | 93 | 95.4 |

The results show increase of gold extraction with increased sulphur oxidation.

EXAMPLE 3

Batch tests were then carried out on the same concentrate under slightly different conditions with different amounts of additives. The initial charge contained 2.2% by weight of plus 100 mesh solids, 373 g dry solids per charge, and the pressure oxidation was carried out for 20 minutes at a pulp density of 13% solids, with 150 kg/t $H_2SO_4$, a temperature of 185° C. and a total pressure of 1500 kPa. The results are shown in Table II.

TABLE II

| Additives, kg/t | | Weight, g | | % |
|---|---|---|---|---|
| Lignosol | Quebracho | +100 mesh | −100 mesh | +100 mesh |
| 1 | 2 | 70 | 285 | 19.7 |
| 1 | 5 | 60 | 302 | 16.6 |
| 13.4 | 6.7 | 90 | 300 | 23.2 |
| 13.4 | 13.4 | 5.7 | 363 | 1.5 |
| 20 | 20 | 5.3 | 341 | 1.5 |
| 0 | 20 | 20.3 | 354 | 5.4 |
| 20 | 0 | 83.7 | 294 | 22.2 |

The results show the large amounts of additives needed to reduce agglomeration.

EXAMPLE 4

Tests were then carried out on the pressure oxidation of the concentrate with recycle of varying amounts of oxidized solids and various pulp densities. No additives were used. The fresh concentrate contained 21.4% S and 2.2% by weight of plus 100 mesh solids. Pressure oxidation was carried out at 185° C., 1500 kPa total pressure and 20 minute retention time. The initial pH of the blended slurry was in the range of 0.8 to 0.9. The recycled solids were 100% minus 100 mesh and typically contained about 11.5% As, 28.2% Fe, 11.9% $SiO_2$, 6.4% S(total), less than 0.1% S (elemental) and 6.34% S (sulphate). The results are shown in Table III.

TABLE III

| Recycle Ratio Residue: Con | Effective % S= in blend | Blend Slurry % solids | % plus 100 mesh fraction in produce* |
|---|---|---|---|
| Nil | 21.4 (concentrate) | 13 | considerable agglomeration |
| 4:1 | 4.28 | 47 | no agglomerates |
| 3.5:1 | 4.76 | 39 | 0.3 |
| 3.5:1 | 4.76 | 33 | 0.2 |

*based on weight of fresh feed concentrate.

The results of these tests show that with adequate dilution of the sulphur content of the fresh feed by oxidized solids and with oxidation at increased solids content in the slurry, agglomeration can be substantially reduced.

EXAMPLE 5

Batch tests were then carried out on the concentrate blended with acidic underflow slurry from a first wash stage thickener generated in a continuous oxidation run. The weight ratio of recycled oxidized solids to fresh concentrate was 4:1, the feed blend slurry contained 45% solids and had an initial pH of 1.2. The oxidation was conducted at 190° C. at 1780 kPa total pressure. The results of the oxidation and of subsequent cyanide amenability are shown in Table IV.

TABLE IV

| | Oxidation Time, min | | | |
|---|---|---|---|---|
| | 30 | 60 | 120 | 180 |
| % sulphur oxidation to sulphate | 58 | 82 | 99.4 | 99.6 |
| % gold extraction | 87 | 94 | 97.3 | 97.6 |

The results, when compared to those of Table 1, clearly demonstrate the effectiveness of the invention, in that the degree of sulphur oxidation and the extraction of gold after 120 and 180 minute oxidation are markedly higher than in the oxidation of the concentrate alone.

The same concentrate as before was then used in continuous test runs.

EXAMPLE 6

In the first run, the pressure oxidation was conducted at 185° C. under 1510 total pressure at a pulp density of 15% solids by weight. Lignosal and quebracho were added at levels of 1 and 2 kg/t concentrate respectively. During the run, severe agglomeration of the solids was experienced in the autoclave. By 24 h, about 15% of the solids had accumulated in the first two compartments, and the run was terminated. It was found by analysis that arsenopyrite and pyrite were predominant sulphides in the agglomerates. The minus 6.7 mm to plus 0.50 mm fractions contained 90.2 to 94.5 g/t Au compared with 33.4 g/t Au in the concentrate, indicating appreciable retention and upgrading of the gold in the agglomerate. Consequently, the oxidation thickener underflow solids contained only 16.3 g/t Au, and accounted for only 40% of the gold fed into the autoclave.

EXAMPLE 7

The second continuous run was conducted with increased agitation in the first two autoclave compartments and at higher addition rates of quebracho (up to 7.5 kg/t) in an attempt to disperse and suspend the agglomerates. Nevertheless, the agglomeration problem persisted during the run, which was terminated after 44 h. Autoclave inspection after the run showed that about 15% of the feed was in the first two compartments, with an additional 13% accumulated in the third compartment. Oxidation thickener underflow solids contained only 11.5 to 19.4 g/t Au.

EXAMPLE 8

A third continuous run was conducted with recycle of oxidazed solids, the recycle ratio of oxidized solids to fresh concentrate being 3.5:1 to produce a blended slurry with a pulp density of 50% solids by weight. The run was continued for 57 h, and no significant agglomeration problem was encountered. Oxidation thickner underflow solids contained 28.5 to 30.7 g/t Au. The advantages of the invention are therefore clearly evident.

Other examples and embodiments will be readily apparent to a person skilled in the art, the scope of the invention being defined in the appended claims.

What I claim as new and desire to protect by Letters Patent of the United States is:

1. A process for the recovery of gold from refractory auriferous iron-containing sulphidic material comprising providing an aqueous feed slurry of fresh feed material and oxidized solids from a subsequent pressure oxidation step, said feed slurry having a pulp density in the range of from about 30 to about 60% by weight, subjecting the slurry to pressure oxidation at a temperature of from about 120° to about 250° C. under a total pressure of from about 360 to about 6000 kPa to produce a slurry of oxidized solids, recycling a portion of the oxidized solids to the feed slurry, and recovering gold from the remaining oxidized solids.

2. A process according to claim 1 wherein the pulp density of the feed slurry is from about 40 to about 55% solids by weight.

3. A process according to claim 1 including recycling oxidized solids to the feed slurry by recycling oxidized slurry directly from the pressure oxidation step.

4. A process according to claim 1 including subjecting oxidized slurry from the pressure oxidation step to a liquid-solids separation step, and recycling oxidized solids to the feed slurry by recycling oxidized solids from the separation step.

5. A process according to claim 4 including washing oxidized slurry from the pressure oxidation step prior to or during the liquid-solids separation step.

6. A process according to claim 1 wherein the weight ratio of recycled oxidized solids to fresh feed material is in the range of from about 0.5:1 to about 10:1.

7. A process according to claim 6 wherein the weight ratio of recycled oxidized solids to fresh feed material is in the range of from about 2.5:1 to about 4:1.

* * * * *